US009295365B2

(12) United States Patent
Huffman et al.

(10) Patent No.: US 9,295,365 B2
(45) Date of Patent: Mar. 29, 2016

(54) EXTRACTOR WITH AUXILIARY FLUID DISPENSER

(75) Inventors: Eric C. Huffman, Lowell, MI (US); Kenneth M. Lenkiewicz, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 2236 days.

(21) Appl. No.: 11/677,334

(22) Filed: Feb. 21, 2007

(65) Prior Publication Data

US 2008/0196193 A1 Aug. 21, 2008

(51) Int. Cl.
*A47L 11/34* (2006.01)
*A47L 11/40* (2006.01)

(52) U.S. Cl.
CPC ..... *A47L 11/34* (2013.01); *A47L 11/4083* (2013.01); *A47L 11/4088* (2013.01)

(58) Field of Classification Search
CPC .. A47L 11/34; A47L 11/4083; A47L 11/4088
USPC ..... 15/320, 321, 322, 331, 347
See application file for complete search history.

(56) References Cited

U.S. PATENT DOCUMENTS

| | | | | |
|---|---|---|---|---|
| 3,101,505 | A | 8/1963 | Belicka et al. | |
| 4,167,799 | A | 9/1979 | Webb | |
| 4,353,145 | A | 10/1982 | Woodford | |
| 5,839,159 | A | 11/1998 | Karr et al. | |
| 6,247,202 | B1 * | 6/2001 | Lesco et al. | 15/320 |
| 6,421,862 | B2 | 7/2002 | Lesco et al. | |
| 6,513,188 | B2 | 2/2003 | Zahuranec et al. | |
| 6,941,614 | B2 | 9/2005 | Montgomery | |
| 7,617,563 | B2 * | 11/2009 | Hertrick et al. | 15/320 |
| 2003/0159232 | A1 * | 8/2003 | Hekman et al. | 15/320 |
| 2005/0132524 | A1 * | 6/2005 | Parr | 15/320 |
| 2006/0037171 | A1 * | 2/2006 | Guest et al. | 15/322 |
| 2006/0272120 | A1 * | 12/2006 | Barrick et al. | 15/321 |

FOREIGN PATENT DOCUMENTS

| | | | |
|---|---|---|---|
| DE | 3038668 | A1 | 5/1982 |
| EP | 1652460 | A1 | 5/2006 |
| GB | 2444864 | A | 6/2008 |

* cited by examiner

*Primary Examiner* — Robert Scruggs
(74) *Attorney, Agent, or Firm* — McGarry Bair PC

(57) ABSTRACT

A surface cleaning apparatus comprising an extractor has a primary fluid delivery system and an auxiliary fluid delivery system. A first button on a handle of the extractor controls the delivery of cleaning fluid from the primary fluid delivery system. A second button on the handle of the extractor controls the delivery of cleaning fluid from the auxiliary fluid delivery system, which includes a spot sprayer mounted to the base assembly through which cleaning fluid is delivered. The handle is provided with an interlock between the first and second buttons so that cleaning fluid cannot simultaneously be delivered by both the primary and auxiliary fluid delivery systems.

20 Claims, 11 Drawing Sheets

EXTRACTOR WITH AUXILIARY FLUID DISPENSER

BACKGROUND OF THE INVENTION

1. Field of the Invention

The invention generally relates to a surface cleaning apparatus that delivers cleaning fluid to a surface to be cleaned. In one of its aspects, the invention relates to an extraction machine which has a general floor cleaning system as well as a special spot treatment system. In another of its aspects, the invention relates to an extraction cleaning machine in which two different detergent cleaning systems can be operated independently of each other.

2. Description of the Related Art

Extractors are well-known devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank.

Some extractors are provided with hand tools that deliver a cleaning fluid to a limited or especially soiled area of the surface to be cleaned. Such hand tools often require a user to stop cleaning the floor to assemble and/or manipulate the hand tool, resume cleaning the floor with the application of the hand tool to the soiled area, stop cleaning the floor again to disassemble and/or store the hand tool, and finally resume cleaning the floor with the extractor. This process lengthens cleaning time and creates added hassle for the user.

U.S. Patent Application Publication No. 2005/0132524 discloses an extractor having a primary distributor for delivering cleaning fluid to a surface to be cleaned beneath a base and auxiliary spray nozzles on an outside of the base for distributing cleaning solution to a pair of edge brushes on the sides of the base. A solenoid valve controls the delivery of solution to the auxiliary spray nozzles and can be operated by a trigger switch on the hand grip of the extractor that also operates a solenoid valve that controls the delivery of solution to the primary distributor. The solenoid valves can also be operated by a separate switch.

U.S. Pat. No. 6,941,614 discloses a carpet grooming attachment for a pile lifter or other motorized brush that has a leading pre-spray nozzle in addition to four primary spray nozzles that are mounted to the attachment.

SUMMARY OF THE INVENTION

According to the invention, a surface cleaning apparatus comprises a housing including a base which is adapted to move along a surface to be cleaned, the base having a front portion and a rear portion, a suction nozzle mounted at the front portion of the base, and a fluid delivery system mounted to the housing. The fluid delivery system includes a fluid supply tank for holding a supply of a cleaning fluid, a primary dispenser for distributing the cleaning fluid from the fluid supply tank to a front portion of the base, rearwardly of the suction nozzle, and onto the surface to be cleaned, and a secondary dispenser for distributing the cleaning fluid from the fluid supply tank to the front portion of the base, forwardly of the suction nozzle, and onto the surface to be cleaned.

The base can include a cover, and the primary dispenser can be positioned within the cover and the secondary dispenser can be positioned on the exterior of the cover. The secondary dispenser can project a spray of cleaning fluid forwardly of the cover. The secondary dispenser can be located on at least one side of the suction nozzle. The secondary dispenser can comprise a spray tip. The spray tip can mounted on an end cap of the base. The end cap can have an opening, and a fluid line extends through opening to the spray tip. The secondary dispenser can further comprise a removable cover positioned over the fluid line.

The fluid delivery system can further comprise a first valve controlling distribution of cleaning fluid from the primary dispenser, a second valve controlling distribution of cleaning fluid from the secondary dispenser, and a first switch selectively connected to the first and second valves for effecting the distribution of the cleaning fluid from either the primary dispenser or the secondary dispenser.

The housing can further include a handle pivotally mounted to base, and the handle comprises a first actuator for controlling distribution of cleaning fluid from the primary dispenser and a second actuator for controlling the distribution of cleaning fluid from the secondary dispenser.

Further according to the invention, a surface cleaning apparatus comprises a housing including a base which is adapted to move along a surface to be cleaned, a suction nozzle mounted to the base and a fluid delivery system mounted to the housing. The fluid delivery system includes a source of cleaning fluid, a primary dispenser for distributing the cleaning fluid from the source of cleaning fluid onto the surface to be cleaned, a secondary dispenser for distributing cleaning fluid from the source of cleaning fluid onto the surface to be cleaned, a first valve controlling distribution of cleaning fluid from the primary dispenser, a second valve controlling distribution of cleaning fluid from the secondary dispenser, and a first switch selectively connected to the first and second valves for effecting the distribution of the cleaning fluid from one of the primary dispenser and the secondary dispenser.

The housing can further include a handle pivotally mounted to base, and the handle comprises a first actuator operably connected to the first valve and a second actuator operably connected to the second valve. The first and second actuators can be positioned on a hand grip of the handle and the first actuator is positioned to be operated by a finger of a user and the second actuator is positioned to be operated by a thumb of the user.

The source of cleaning fluid can comprise a fluid supply tank. The source of cleaning fluid can comprise multiple fluid supply tanks. The primary dispenser can distribute the cleaning fluid from one of the multiple fluid supply tanks and the secondary dispenser distributes the cleaning fluid from another of the multiple fluid supply tanks. The surface cleaning apparatus can further comprise a metering valve assembly for selectively controlling the concentration of the cleaning fluid to the primary and secondary dispensers. The metering valve can be controlled to distribute one concentration of the cleaning fluid to the primary dispenser and a different concentration of the cleaning fluid to the secondary dispenser.

The surface cleaning apparatus can further comprise a second switch connected to the first valve for effecting distribution of the cleaning fluid from the primary dispenser. The second switch can be operable to effect distribution of the cleaning fluid when the first switch is connected to the first valve.

DESCRIPTION OF THE PREFERRED EMBODIMENT

Figure 1:
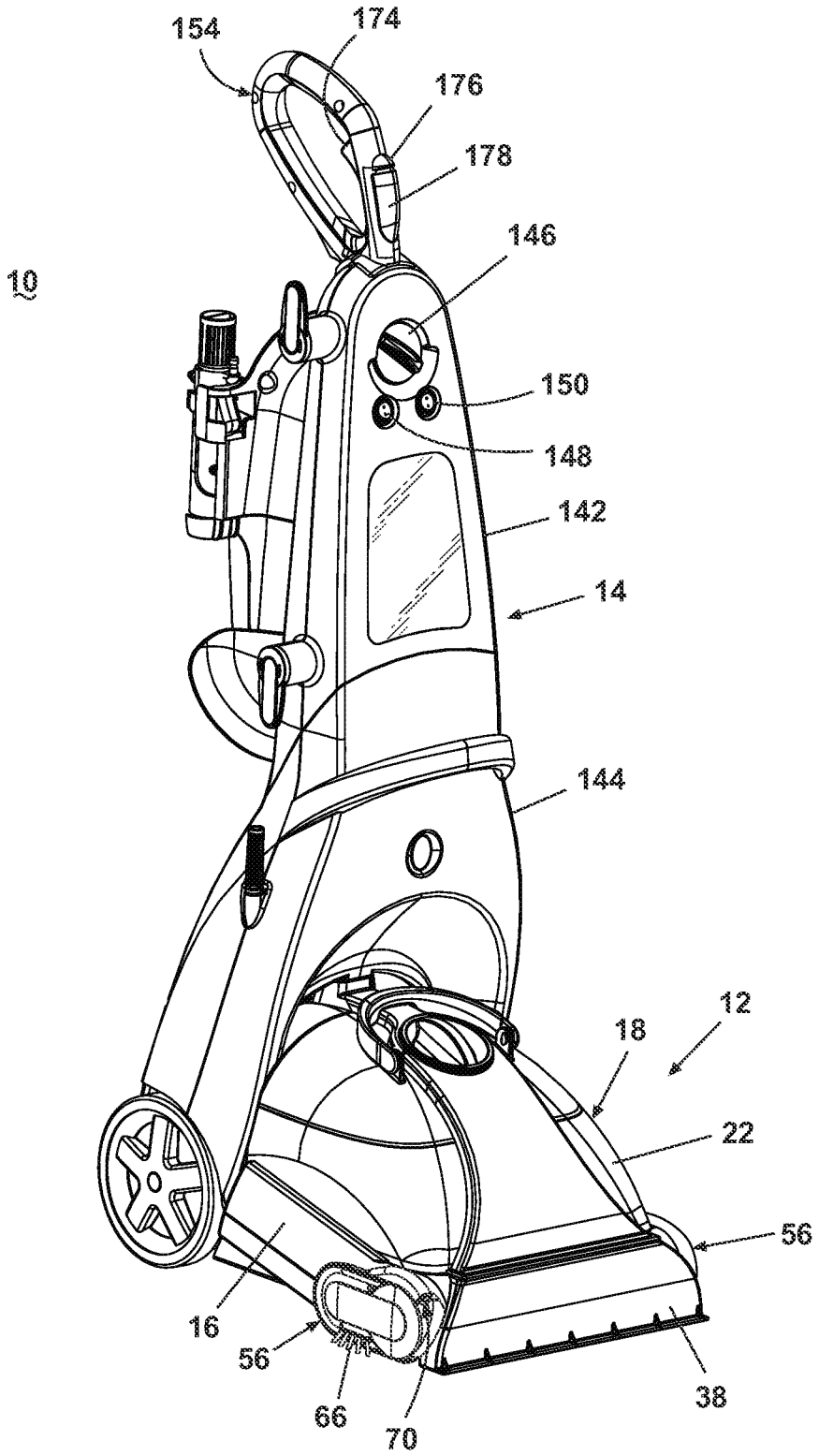
FIG. 1 is a front, right perspective view of an extractor according to the invention with a handle assembly pivotally mounted to a foot assembly.
Figure 2:
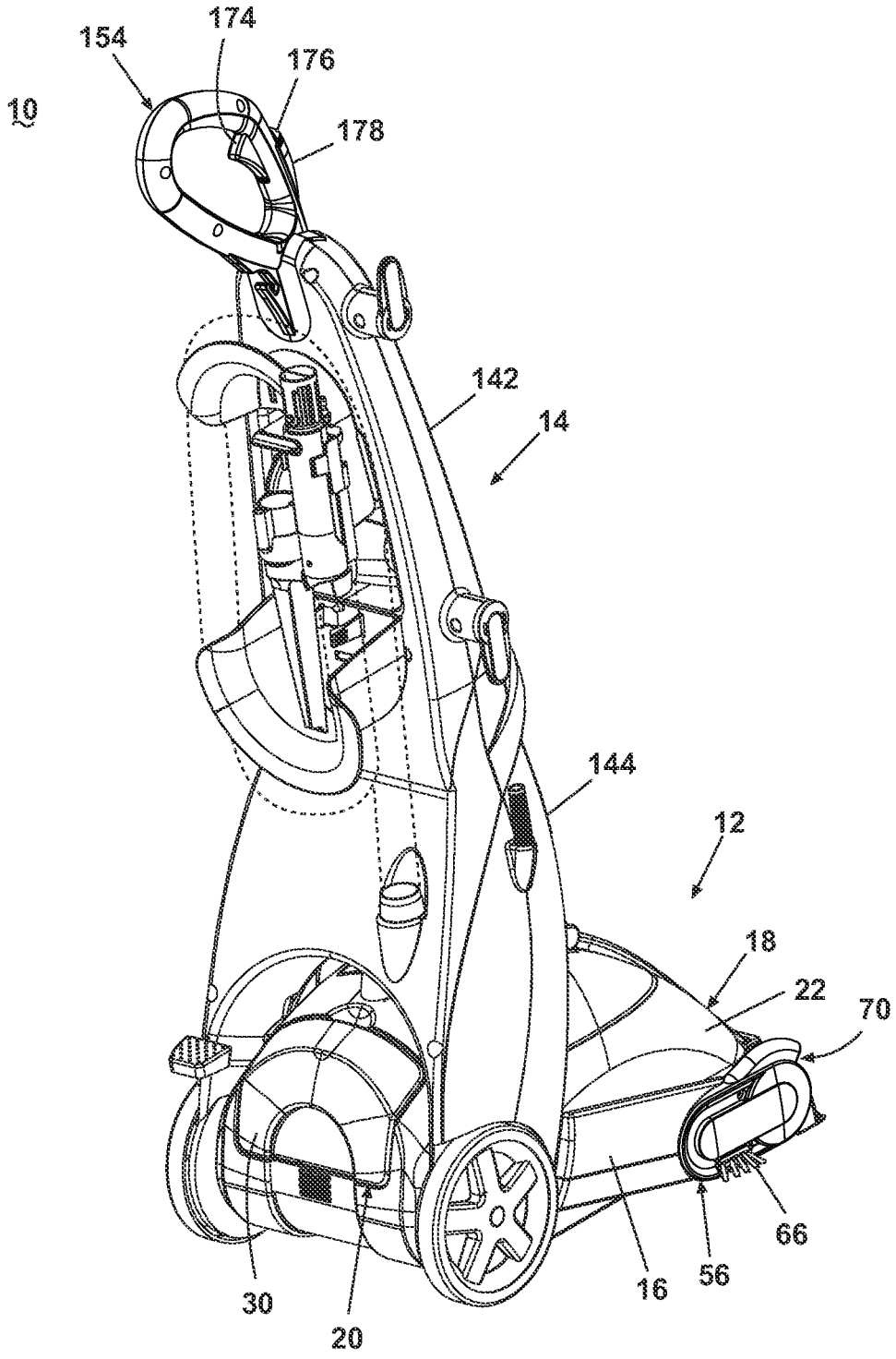
FIG. 2 is a rear, right perspective view of the extractor of FIG. 1.

Referring now to the drawings and particularly to FIGS. 1-2, an upright extractor 10 according to the invention comprises a housing having a foot assembly 12 for movement across a surface to be cleaned and an upright assembly 14 pivotally mounted to a rearward portion of the foot assembly 12 for directing the foot assembly 12 across the surface to be cleaned. The extractor 10 includes a fluid delivery system for storing cleaning fluid and delivering the cleaning fluid to the surface to be cleaned. The extractor 10 is further provided with other known components, such as a fluid recovery system (not shown) for removing the spent cleaning fluid and dirt from the surface to be cleaned and storing the spent cleaning fluid and dirt, which are not germane to the invention and therefore will be described in detail herein. Details of a suitable fluid recovery system for an extractor, as well as a description of other common extractor components, are disclosed in commonly assigned U.S. Pat. No. 6,131,237 to Kasper et al. and U.S. patent application Ser. No. 11/276,167 to Lenkiewicz at el. The components of the fluid delivery system and the fluid recovery system are supported by at least one of the base assembly 12 and the upright assembly 14.

The fluid delivery system further includes a primary fluid delivery system and an auxiliary fluid delivery system. As illustrated herein, the primary and auxiliary fluid delivery systems share a common source of cleaning fluid; however separate sources of cleaning fluid can be provided for the primary and auxiliary fluid delivery systems and therefore, the primary and auxiliary fluid delivery systems can deliver different concentrations of cleaning solution. The fluid recovery system recovers fluid delivered to the surface to be cleaned regardless of the source of the fluid. The primary fluid delivery system is used during a normal cleaning operation to deliver cleaning fluid to the surface to be cleaned, while the auxiliary fluid delivery system is used intermittently at a user's discretion to deliver a focused spray of cleaning fluid to a limited area of the surface of the cleaned separate and apart from the primary fluid delivery system. The focused spray may simply deliver additional cleaning fluid to the limited area, or it may deliver a different cleaning fluid formula, such as a more concentration version of the cleaning fluid delivered by the primary fluid delivery system.

Figure 3:
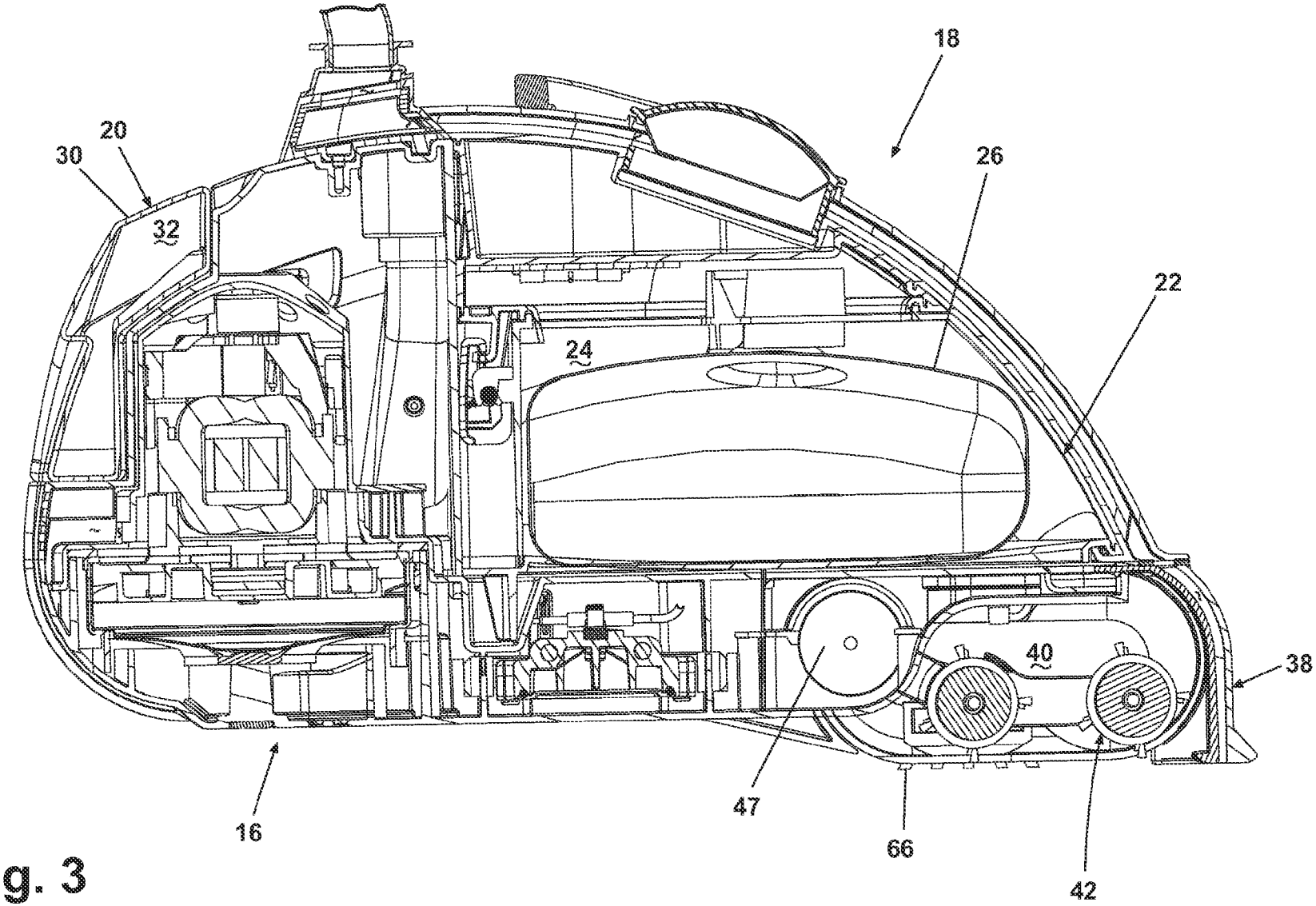
FIG. 3 is a sectional view of the foot assembly taken along line 3-3 of FIG. 1.
Figure 10:
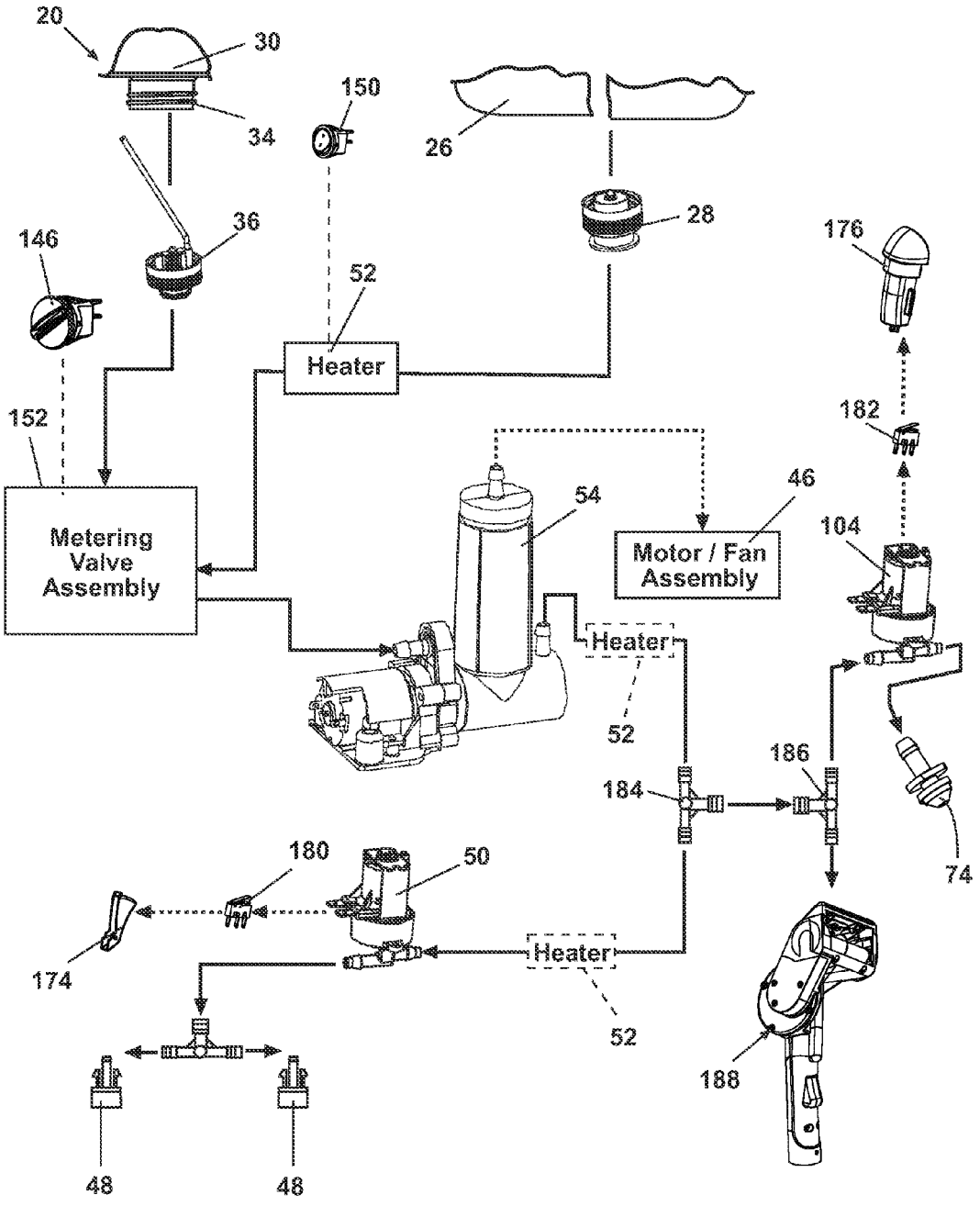
FIG. 10 is a schematic diagram of a fluid flow pathway for the fluid delivery system for the extractor of FIG. 1.

Referring additionally to FIGS. 3 and 10, the foot assembly 12 comprises a base assembly 16 that supports a recovery tank assembly 18 at a forward portion thereof, forward being defined as relative to the mounting location of the handle assembly 14 on the foot assembly 12, and a solution supply tank assembly 20 at a rearward portion thereof. The recovery tank assembly 18 comprises a recovery tank housing 22 that defines a recovery chamber 24 used to stored spent cleaning fluid and dirt that is recovered from the surface to be cleaned. The recovery tank housing 22 is sized to receive a flexible bladder 26 that is utilized as a cleaning fluid supply tank and stores a first cleaning fluid. A suitable bladder is disclosed in the above referenced Kasper '237 patent. The bladder 26 comprises an outlet (not shown) that is secured to a valve mechanism 28 for controlling flow of the first cleaning fluid from the bladder 26. The solution supply tank assembly 20 comprises a solution supply tank housing 30 that defines a solution supply chamber 32 and stores a second cleaning fluid. The solution supply tank housing 20 has an outlet 34 in a bottom wall thereof that receives a valve mechanism 36 for controlling flow of the second cleaning fluid from the solution supply chamber 32. The first and second cleaning fluids can comprise any suitable cleaning fluid, including, but not limited to, water, concentrated detergent, diluted detergent, and the like. Preferably, the first cleaning fluid is water, and the second cleaning fluid is concentrated detergent. Both the primary and auxiliary fluid delivery systems can deliver cleaning fluid from one or both of the bladder 26 and the solution supply tank housing 30 onto the surface to be cleaned. Although not illustrated, other supply tanks or containers can be provided such that the primary and auxiliary fluid delivery systems deliver cleaning fluid from separate tanks or containers that contain the same or different concentrations or compositions of cleaning fluid.

Figure 4:
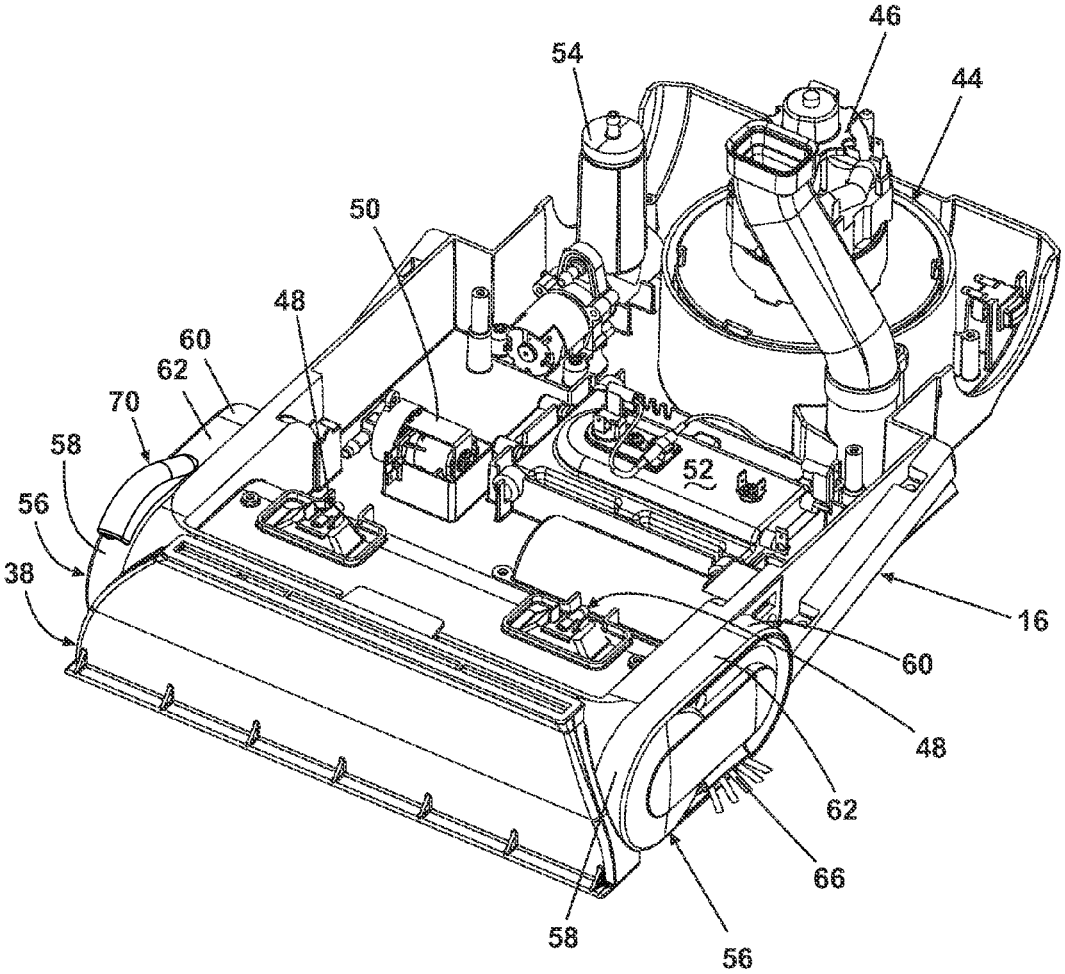
FIG. 4 is a perspective view of the foot assembly of FIG. 1 with some components thereof removed to illustrate, among other things, a spray tip assembly.

Referring to FIGS. 3 and 4, the base assembly 16 further comprises a nozzle assembly 38 removably mounted to a forward portion thereof. The nozzle assembly 38 is in fluid communication with the recovery chamber 24, when the recovery tank assembly 18 is mounted to the base assembly 16, such that spent cleaning fluid and debris ingested through the nozzle assembly 38 is collected in the recovery chamber 24. A downwardly facing agitator cavity 40 is provided to the rear of the nozzle assembly 38 and receives an agitator assembly 42. At a rearward portion, the base assembly 16 includes a motor and fan assembly housing 44 for supporting a vacuum source in the form of a vertically oriented motor and fan assembly 46. The motor and fan assembly 46 is in fluid communication with the recovery chamber 24, when the recovery tank assembly 18 is mounted to the base assembly 16, such that air is drawn through the motor and fan assembly 46 before being exhausted from the extractor 10. A separate agitator motor 47 can be provided for driving the agitator assembly 42.

The primary fluid delivery system includes a pair of spray tips 48 located on the base assembly 16 that function as a dispenser for distributing fluid onto the surface to be cleaned. Details of the spray tips 48 are given in the Lenkiewicz application, referenced above. The spray tips 48 are in fluid communication with the agitator cavity 40 so that the fluid can be supplied from the spray tips 48 to the surface to be cleaned. The primary fluid delivery system further includes a primary spray tip valve 50 having an outlet that is in fluid communication with the spray tips 48. The primary spray tip valve is preferably a solenoid valve, but can alternatively be a mechanically operated valve. The base assembly 16 also includes an optional heater 52 and a pump assembly 54. The heater 52 can be any suitable heater that can heat fluids and is preferably an in-line heater. The pump assembly 54 has an outlet in fluid communication with an inlet of the spray tip valve 40.

The agitator cavity 40 is accessible for replacing or repairing the agitator assembly 42. An end cap 56 is removably mounted to each side of the base assembly 16 by mechanical fasteners, such as with screws or detents. As best seen in FIGS. 4 and 5, the end caps 56 have an elongated oval shape with curved front and rear ends 58, 60 joined by straight top and bottom portions 62, 64, and carry agitators in the form of stationary, optionally removable edge brushes 66. The edge brushes 66 can be mounted to the end caps 56 in any suitable manner, such as by a press-fit or with mechanical fasteners. In the illustrated embodiment, the edge brushes 66 are snap-fit into a correspondingly shaped brush receiver aperture 68 in the respective end cap 56. In one embodiment, the end caps 56 are translucent so that the agitator assembly 42 is at least partially visible to the user. In another embodiment, the end caps 56 are colored for aesthetic purposes.

Figure 5A:
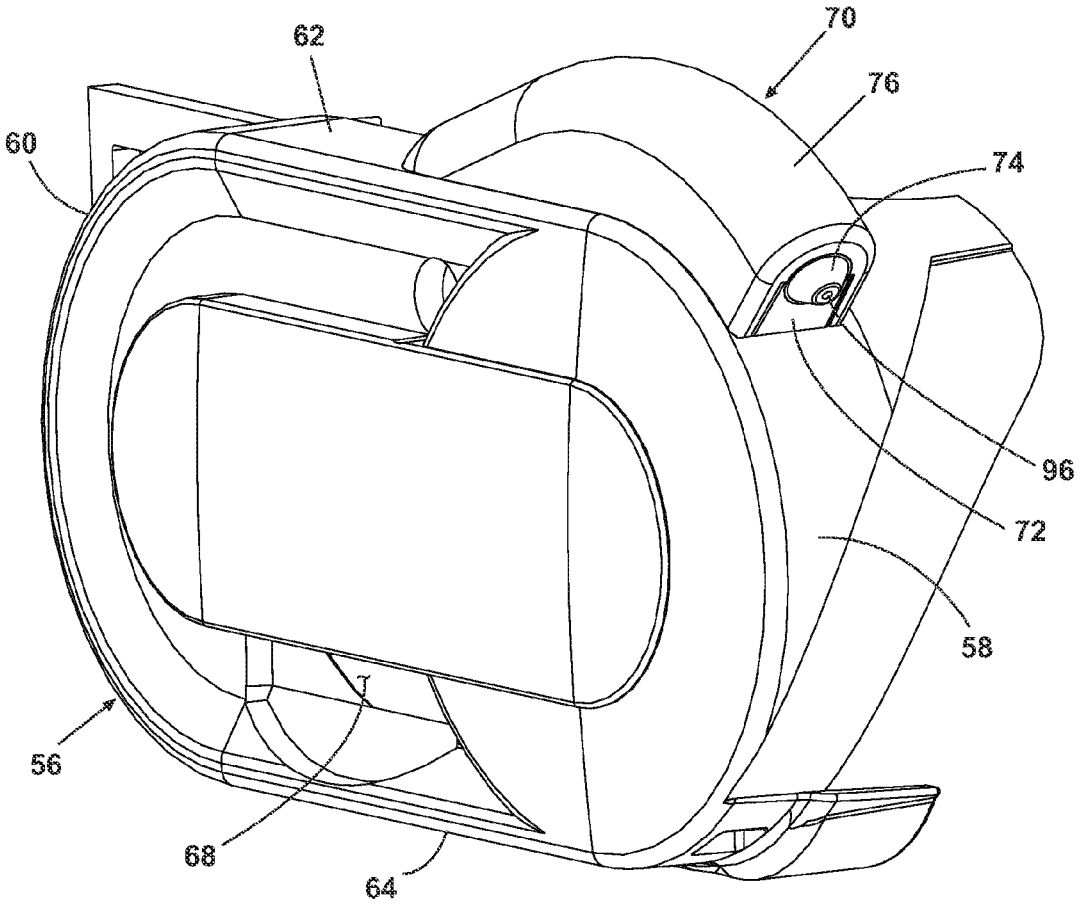
FIG. 5A is a perspective view of the spray tip assembly from FIG. 4, comprising a spray tip, a spray tip receiver, and a spray tip cover.
Figure 5B:
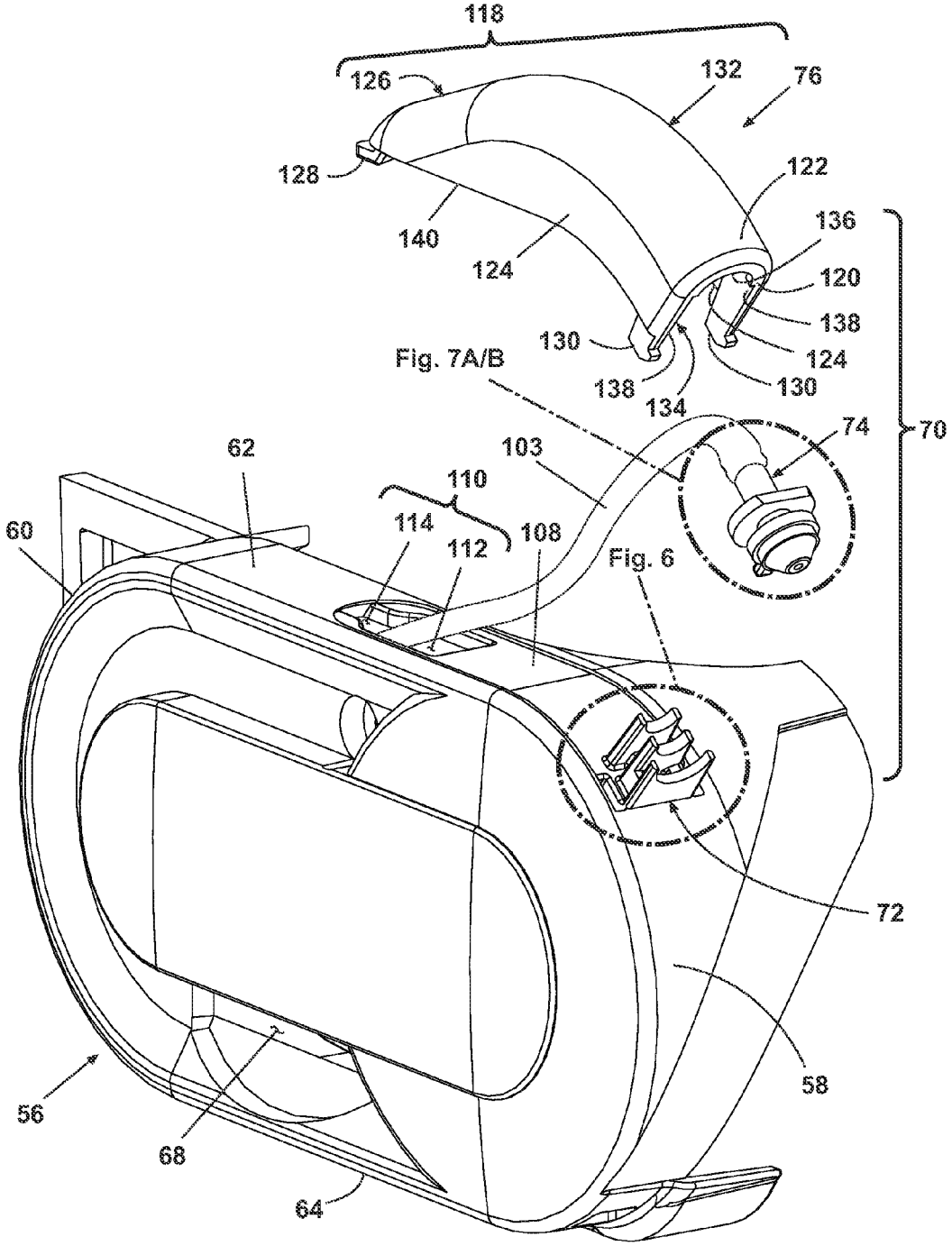
FIG. 5B is an exploded view of the spray tip assembly from FIG. 5A.

Referring to FIGS. 5A and 5B, in the illustrated embodiment, the right end cap 56 includes a spot sprayer assembly 70 comprising a spray tip receiver 72 that removably mounts a spray tip 74 that functions as a dispenser for the auxiliary fluid cleaning system and distributes cleaning fluid onto the surface to be cleaned, and a spray tip cover 76 that removably mounts to the right end cap 56 to substantially cover the spray tip 74 and spray tip receiver 72.

Figure 6:
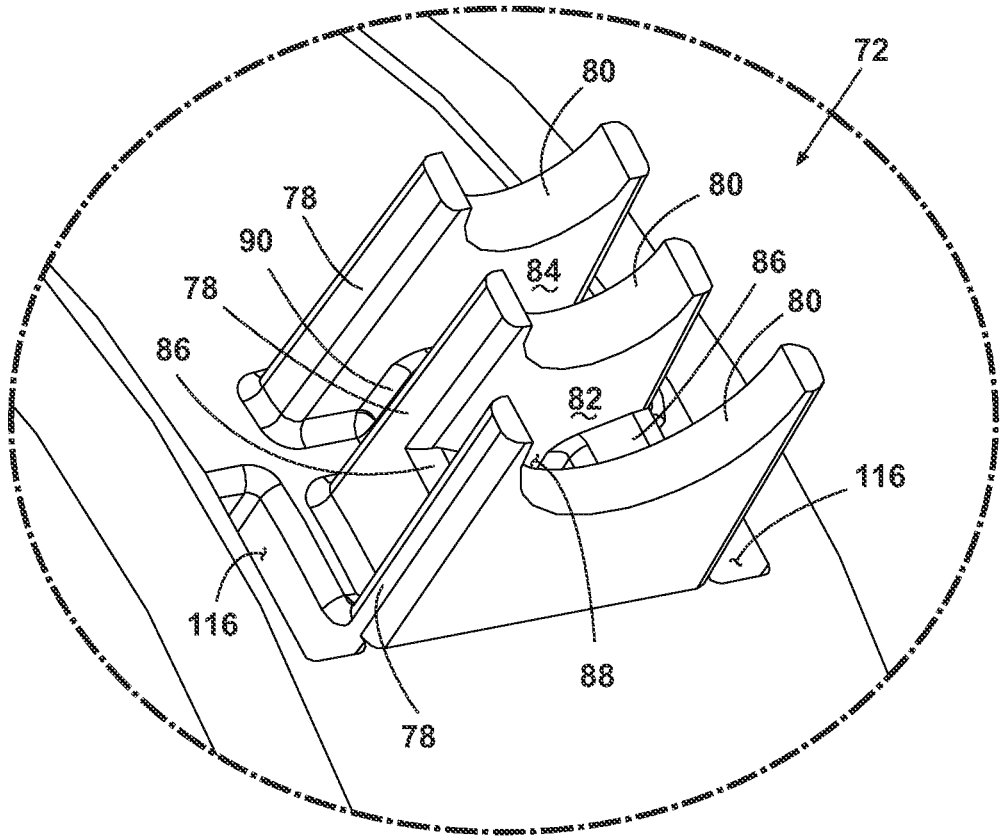
FIG. 6 is a close-up view of the spray tip receiver from FIG. 5B.

Referring to FIG. 6, each spray tip receiver 72 is formed by three generally parallel walls 78 extending normally from the upper curved front end 58 of the right end cap 56. The three walls 78 each comprises a concavely curved upper surface 80 and are spaced from one another to create a forward space 82 between the two forward-most walls 78, and a rearward space 84 between the two rearward-most walls 78. The two forward-most walls 78 are further connected near their bases by two ridges 86 having a slot 88 formed centrally therein. The two rearward-most walls 78 are further connected near their bases by a ridge 90.

Figure 7A:
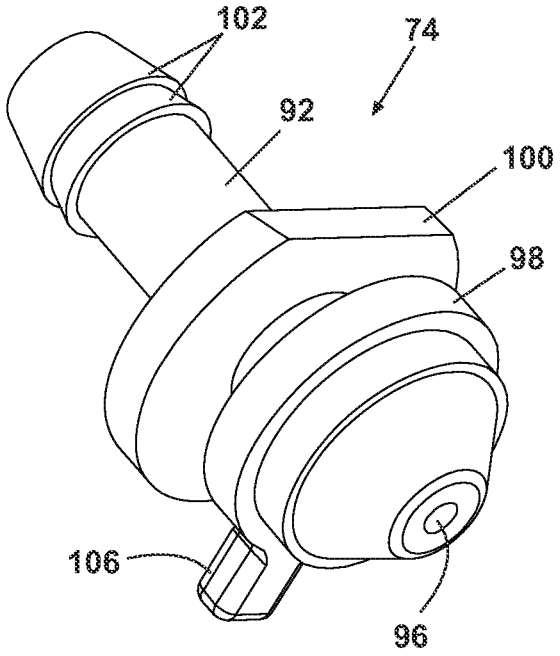
FIG. 7A is a front perspective view of the spray tip from FIG. 5B.
Figure 7B:
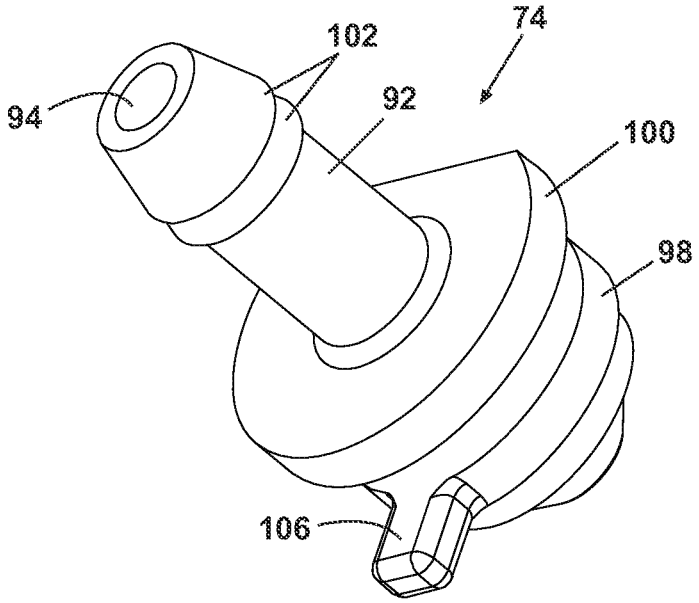
FIG. 7B is a rear perspective view of the spray tip from FIG. 5B.
Figure 8:
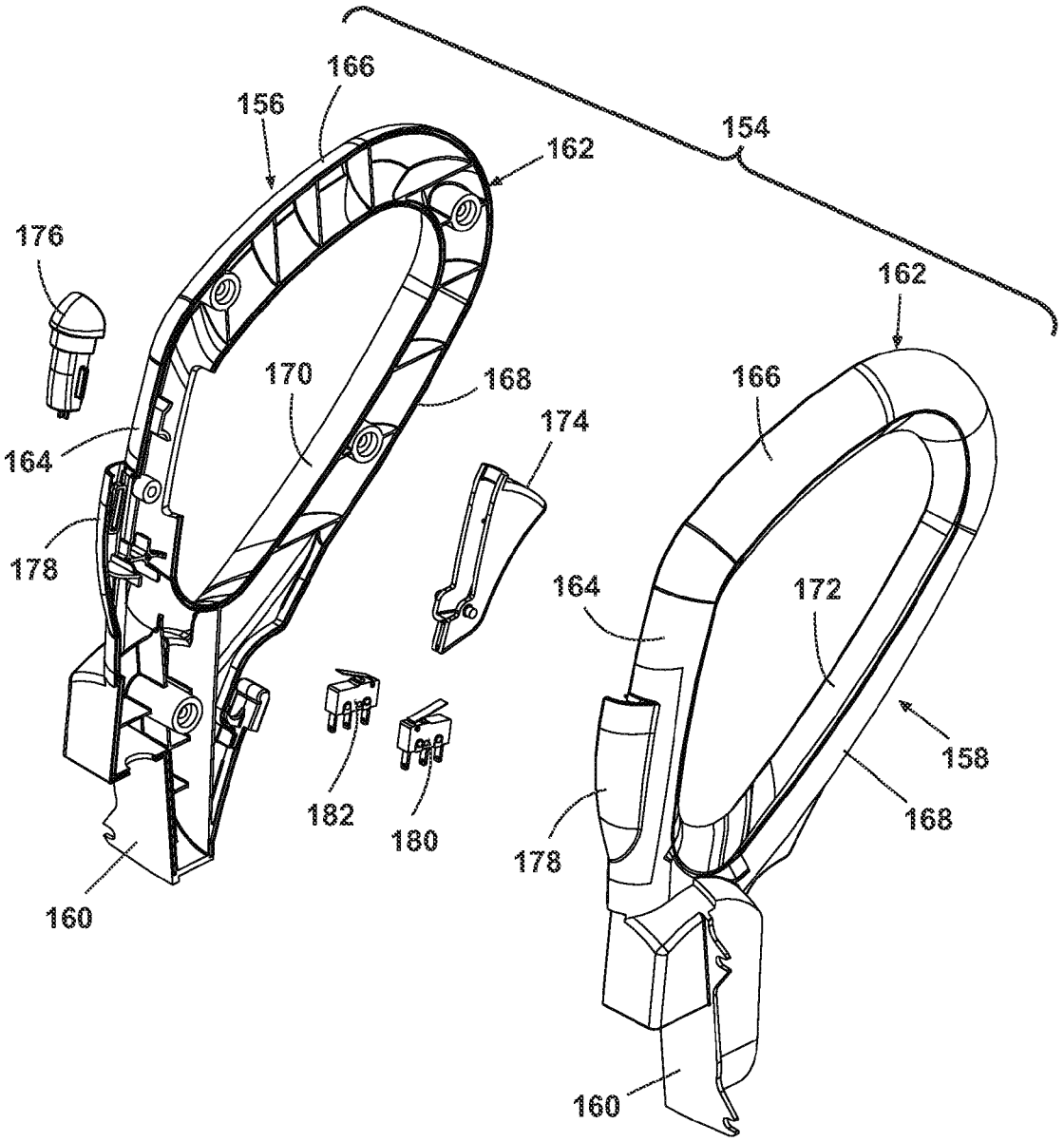
FIG. 8 is an exploded view of a portion of the handle assembly from FIG. 1.

Referring to FIGS. 7A and 7B, each spray tip 74 comprises a spray tip conduit 92 that extends from a rearward inlet 94 to a forward outlet 96, and a pair of spaced resilient mounting flanges 98, 100 that extend around the conduit 92. The spray tip conduit 92 is further provided with ribs 102 near the rearward inlet 94 that frictionally engages a fluid conduit 103 (FIG. 5B) in fluid communication with the outlet of an auxiliary spray tip valve 104 (FIG. 10), which can be located in the foot assembly 12 or in the upright assembly 14. Preferably, the auxiliary spray tip valve 104 is located in a lower portion of the upright assembly 14. The auxiliary spray tip valve 104 is also preferably a solenoid valve, but can alternatively be a mechanically operated valve. The forward mounting flange 98 further comprises a downwardly extending tab 106. When mounted to the spray tip receiver 72, the forward mounting flange 98 is received in the forward space 82, with the tab 106 received within the slot 88, and the rearward mounting flange 100 is received in the rearward space 84.

Referring to FIG. 5B, the right end cap 56 further comprises a shallow depression 108 formed in the top portion 62 and extending between and around the spray tip receiver 72 and a rear slot opening 1 10. The rear slot opening 110 comprises a wide portion 112 continuously formed with a narrow portion 114. Front slot openings 116 are formed within the depression 108 and are positioned on either side of the spray tip receiver 72. The fluid conduit 103 that fluidly communicates the spray top 74 with the source of cleaning fluid extends through the slot opening 110 to couple with the rearward inlet 94.

The spray tip cover 76 comprises a shell-like body 118 having a front surface 120 joined to a curved upper surface 122 and two spaced side surfaces 124 depending downwardly from the curved upper surface 122. The curved upper surface 122 and the side surfaces 124 taper rearwardly from the front surface 120 to form a tail section 126 of the body 118. A rear mounting tab 128 extends from the tail section 126 and two front mounting tabs 130 extend from the side surfaces 124, adjacent the front surface 120. The portion of the body 118 forward of the tail section 126 generally forms a head section 132, which is sized to cover the spray tip 74 and spray tip receiver 72 when the spray tip cover 76 is mounted to the end cap 56. The front surface 120 is further formed with a cut-out 134 having an arcuate upper edge 136 shaped to fit around the spray tip 74 and two side corner edges 138 shaped to fit around the forward-most wall 78 of the spray tip receiver 72. Furthermore, the body 118 comprises a lower edge 140 that is shaped to conform to the profile of the end cap 56

To removably attach the spray tip cover 76 to the end cap 56, with the tail section 126 of the body 118 orientated toward the top portion 62, the rear mounting tab 128 is inserted into the wide portion 114 of the rear slot opening 110 and slid into the narrow portion 114. The narrow portion 114 is sized to frictionally engage the rear mounting tab 128 to retain it on the end cap 56 by friction-fit. The head section 132 is then rotated about the tail section 126 to bring the front mounting tabs 130 into engagement with the front slot openings 116 and are snap-fit therein.

The handle assembly 14 comprises an upper handle 142 removably mounted to a lower handle 144. A plurality of controls are provided on the upper handle 142, including a cleaning mode knob 146, a main power switch 148, and a heater switch 150. The cleaning mode knob 146 controls a metering valve assembly 152, as will be presently described. The main power switch 148 is operatively connected to the motor and fan assembly 46, the pump assembly 54, the agitator motor 47, and a power cord 153 (shown schematically in FIG. 9) used to couple the extractor 10 to a source of power. The heater switch 150 functions to activate the heater 52 when heated cleaning is desired.

A handle grip 154 mounted to an upper portion of the upper handle 142 facilitates movement of the extractor 10 by the user across the surface to be cleaned. The handle grip 154 is formed by two mating halves 156, 158 and comprises a stem 160 for mounting the handle grip 154 to the upper handle 142 and an integral, generally triangular grip portion 162 with arcuate corners. The grip portion 162 is formed by a generally vertical, upright section 164 joined at an obtuse angle to one end of an upwardly and rearwardly extending hand section 166 and a connecting section 168 that connects an opposite end of the hand section 166 to the upright section 164 at the stem 160. Optionally, each mating half 156, 158 can include a comfort grip 170, 172 made of rubber or other suitable polymer to provide a comfortable gripping surface for the user's hand and positioned on the interior of the grip portion 162. During normal use of the extractor 10, a user grips the handle grip 154 by wrapping a hand around the hand section 166.

The handle grip 154 further comprises a trigger button 174 and a push button 176 secured between the mating halves 156, 158. The trigger button 174 is positioned at a rear side of the upright section 164 for easy manipulation by a trigger finger of the user and the push button 176 is retained within a pocket 178 formed on a front side of the upright section 164 for easy manipulation by a thumb of the user. The trigger button 174 and the push button 176 are operatively coupled to a first microswitch 180 and a second microswitch 182, respectively, which are located in a cavity formed between the mating halves 156, 158. As will be discussed in more detail hereinafter, the first microswitch 180 is electrically coupled to the primary spray tip valve 50 in the foot assembly 12 and the second microswitch 182 is electrically coupled to the auxiliary spray tip valve 104. Thus, delivery of cleaning fluid from the primary fluid dispensing system is controlled by the trigger button 174 and delivery of cleaning fluid from the spot sprayer assembly 70 is controlled by the push button 176.

The primary and auxiliary fluid delivery systems are preferably configured to dispense cleaning fluid alternately. To accomplish this, an interlock is provided between the primary and auxiliary fluid delivery systems. In other words, when the auxiliary fluid delivery system is dispensing cleaning fluid, the primary fluid delivery system cannot, and vice versa. The interlock can be mechanical, and can be associated with the trigger button 174 and the push button 176 such that when the trigger button 174 is depressed, the push button 176 cannot be depressed, and when the push button 176 is depressed, the trigger button 174 cannot be depressed.

Figure 9:
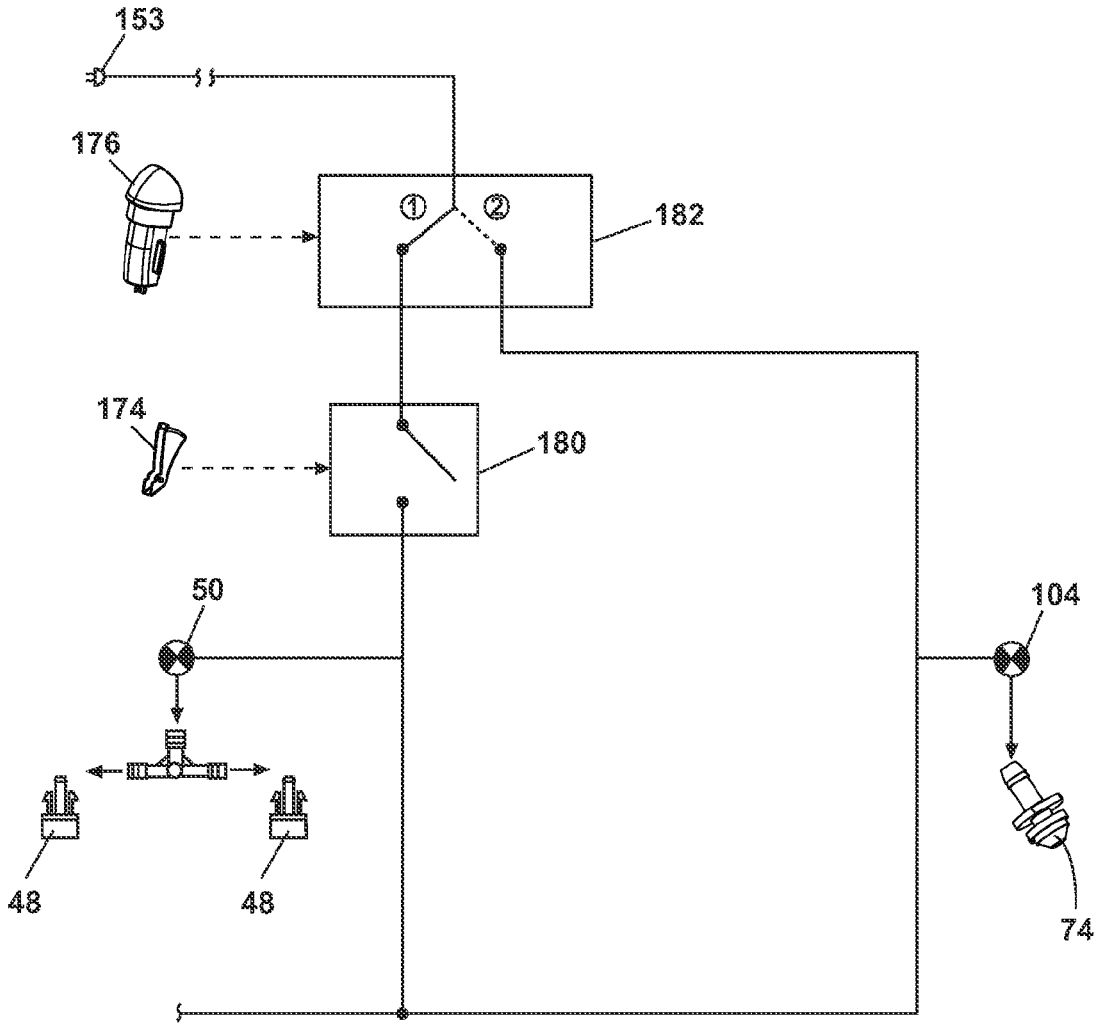
FIG. 9 is a schematic diagram of an electrical control pathway for the fluid delivery system for the extractor of FIG. 1.

In another embodiment, the interlock is an electrical control that prevents the primary and auxiliary spray tip valves 50, 104 from being open simultaneously. Referring to FIG. 9, an electrical control pathway for the fluid delivery system illustrating the interlock is schematically shown. The first microswitch 180 is movable between a normally open position and a closed position. The second microswitch 182 can be a two-position switch that is movable between a first normally closed position (Position 1) and second closed position (Position 2). Depression of the trigger button 174 moves the first microswitch 180 from the normally open position to the closed position, and depression of the push button 176 moves the second microswitch 182 from Position 1 to Position 2. When the microswitches 180, 182 are closed, electrical current is supplied from the power cord 153, which is coupled with a source of electrical power, such as a household outlet, to one of the spray tip valves 50, 104, causing it to open and allow fluid to flow therethrough. Specifically, when the trigger button 174 is depressed, the first microswitch 180 closes and electrical current is supplied to the primary spray tip valve 50, causing it to open, thereby allowing fluid to flow therethrough. When the push button 176 is depressed, the second microswitch 182 moves to Position 2 and electrical current is supplied to the auxiliary spray tip valve 104, causing it to open, thereby allowing fluid to flow therethrough. Thus, even if the trigger button 174 and the push button 176 are depressed at the same time, fluid will only be dispensed from the auxiliary fluid delivery system as no electrical current will be supplied to the primary spray tip valve 50.

For visual clarity, the various electrical and fluid connections within the fluid delivery system are not shown in the drawings described above but are depicted schematically in FIG. 10. Referring now to FIG. 10, the fluid delivery system comprises the bladder 26 for storing a first cleaning fluid and the solution supply tank housing 30 of the solution supply tank assembly 20 for storing a second cleaning fluid. The first and second cleaning fluids are dispensed from the bladder 26 and the solution supply tank housing 30 through the respective valve mechanisms 28, 36. Preferably, the valve mechanisms 28, 36 are normally closed when the bladder 26 and the solution supply tank housing 30 are removed from the extractor 10 and automatically open upon being seated on the base assembly 16.

The first cleaning fluid flows from the bladder 26 and through the optional heater 52, which heats the first cleaning fluid when the heater 52 is activated through the heater switch 150, to a metering valve assembly 152. There, the first cleaning fluid optionally mixes with the second cleaning fluid from the solution supply tank housing 30. The concentration of the mixture can vary from comprising only the first cleaning fluid to comprising only the second cleaning fluid and can depend on a cleaning mode the user selects using the cleaning mode knob 146. Exemplary valve mechanisms and heaters are disclosed in the aforementioned Lenkiewicz application and Kasper patent, as well as in U.S. Patent Application No. 60/521,693, which are incorporated herein by reference in their entirety.

The concentration of the cleaning fluid mixed by the metering valve assembly 152 can be determined entirely by the cleaning mode selected by the user using the cleaning mode knob 146, or it can be at least partially dependent on whether the trigger button 174 or the push button 176 is depressed. For example, the fluid delivery system can be configured so that the primary fluid delivery system delivers a concentration of cleaning fluid determined by the cleaning mode selected by the user using the cleaning mode knob 146 and the auxiliary fluid delivery system delivers a different concentration of cleaning fluid, regardless of which cleaning mode is selected.

Regardless of how the concentration of cleaning fluid is determined, after flowing through the metering valve assembly 152, the mixture of cleaning fluid(s) flows to the pump assembly 54, which pressurizes the cleaning fluid. The pump assembly 54 is operatively connected to the motor and fan assembly 46 for operation of a primer stack portion thereof, as described in the aforementioned Kasper patent.

Downstream from the pump assembly 54, the cleaning fluid flows through a first tee 184 to deliver the cleaning fluid to the primary spray tip valve 50 and to a second tee 186. The second tee 186 delivers the cleaning fluid to the auxiliary spray tip valve 104 and to an optional accessory tool 188. The accessory tool 188 and its associated fluid and electrical connections are more fully described in the aforementioned Lenkiewicz application.

As described above, the primary spray tip valve 50 is controlled by the first microswitch 180 in the handle grip 154. When a user depresses the trigger button 174 on the handle assembly 14, the microswitch 180 opens the primary spray tip valve 50 to deliver the cleaning fluid to the spray tips 48 for dispensation onto the surface to be cleaned. Optionally, the spray tips 48 can be oriented to dispense the cleaning fluid onto the agitator assembly 42 for delivering the cleaning fluid to the surface to be cleaned.

Also as described above, the auxiliary spray tip valve 104 is controlled by the second microswitch 182 in the handle grip 154. When a user depresses the push button 176 on the handle assembly 14, the microswitch 182 opens the auxiliary spray tip valve 104 to deliver the cleaning fluid to the spray tip 74 for dispensation onto a selected area of the surface to be cleaned. Optionally, the spray tip 74 can be oriented to dispense the cleaning fluid onto the edge brush 66 for delivering the cleaning fluid to the surface to be cleaned.

As will be recognized by one skilled in the extractor art, various modifications can be made to the fluid delivery system. For example, the heater 52 and the pump assembly 54 are optional, or the heater 52 can be positioned downstream of the pump assembly 54 either before or after the tee fitting 184. Additionally, the spray tips 48, 74 can be replaced with another type of fluid distributor. Furthermore, the fluid flow rate through the spray tips 48, 74 can be the same or it can be different. For example, the fluid flow rate through the spray tip 74 of the spot sprayer assembly 70 of the auxiliary fluid delivery system can be less than the fluid flow rate through the spray tips 48 of the primary fluid delivery system.

In operation, with the handle assembly 14 pivoted, the user moves the extractor 10 along the surface to be cleaned while applying the cleaning fluid as desired using the primary fluid delivery system by depressing the trigger button 174 with the same hand that holds the handle grip 154 at the hand section 166. The cleaning fluid is dispensed through the spray tips 48, and the surface to be cleaned is agitated by the agitator assembly 42 and the edge brushes 66. When the user desires to supplement the normal cleaning operation, cleaning fluid is applied using the auxiliary fluid delivery system by depressing the push button 176. In this instance, cleaning fluid is dispensed through the spray tip 74. When the user desires to perform above-the-floor cleaning, the accessory tool 188 is employed. The spent cleaning fluid and dirt on the surface to be cleaned is removed, either by the nozzle assembly 38 during on-the-floor cleaning or by the accessory tool during above-the-floor cleaning, and flows into the recovery chamber 24, where the spent cleaning fluid and dirt is removed from the working air. The working air continues out of the recovery chamber 24 to the motor and fan assembly 46, and the exhaust air from the motor and fan assembly 46 is exhausted from the foot assembly 12 via vents or other suitable exhaust means.

While the invention has been specifically described in connection with certain specific embodiments thereof, it is to be understood that this is by way of illustration and not of limitation. For example, only one end cap is shown provided with the spray tip assembly 70; however, both end caps can be provided with the spray tip assembly, or spray tip assemblies can be provided on other locations on the base assembly. The scope of the appended claims should be construed as broadly as the prior art will permit.

What is claimed is:

1. A surface cleaning apparatus comprising:

a housing including an upright handle assembly and a base pivotally mounted to the upright handle assembly and which is adapted to move along a surface to be cleaned, the base having a cover, a front portion and a rear portion;

a suction nozzle mounted at the front portion of the base adapted to contact the surface to be cleaned;

a vacuum source in fluid communication with the suction nozzle for extraction of cleaning fluid from the surface to be cleaned; and a fluid delivery system mounted to the housing and including:

a fluid supply tank for holding a supply of a cleaning fluid;

a primary dispenser positioned within the cover for distributing the cleaning fluid from the fluid supply tank to the front portion of the base, rearwardly of the suction nozzle, and onto the surface to be cleaned; and a secondary dispenser positioned exteriorly of the cover and oriented in a forward direction to distribute the cleaning fluid from the fluid supply tank forwardly of the suction nozzle;

wherein the secondary dispenser is configured to project a spray of cleaning fluid outwardly from the base in a forward direction in front of the suction nozzle onto a limited area of the surface to be cleaned for subsequent extraction by the suction nozzle as the base moves forwardly along the surface to be cleaned.

2. The surface cleaning apparatus from claim 1, wherein the base comprises a side portion between the front and rear portions, and the secondary dispenser is located on the side portion laterally of the suction nozzle.

3. The surface cleaning apparatus from claim 1 wherein the secondary dispenser comprises a spray tip.

4. The surface cleaning apparatus from claim 3 wherein the base comprises an end cap at a side portion thereof, and at least the spray tip of the secondary dispenser is mounted on the end cap of the base.

5. The surface cleaning apparatus from claim 4 wherein the end cap has an opening, and a fluid line extends through opening to the spray tip to fluidly connect the spray tip with the fluid supply tank.

6. The surface cleaning apparatus from claim 5, wherein the secondary dispenser further comprises a removable cover positioned over the fluid line.

7. The surface cleaning apparatus from claim 1, wherein the fluid delivery system further comprises a first valve controlling distribution of cleaning fluid from the primary dispenser, a second valve controlling distribution of cleaning fluid from the secondary dispenser, and a first switch selectively connected to the first and second valves for effecting the distribution of the cleaning fluid from either the primary dispenser or the secondary dispenser.

8. The surface cleaning apparatus from claim 1, wherein the housing further includes a handle pivotally mounted to base, and the handle comprises a first actuator for controlling distribution of cleaning fluid from the primary dispenser and a second actuator for controlling the distribution of cleaning fluid from the secondary dispenser.

9. A surface cleaning apparatus comprising:

a housing including a base which is adapted to move along a surface to be cleaned and which comprises a cover;

a suction nozzle mounted to the base;

a fluid delivery system mounted to the housing and including:

a source of cleaning fluid;

a primary dispenser positioned within the cover for distributing the cleaning fluid from the source of cleaning fluid onto the surface to be cleaned;

a secondary dispenser positioned on an exterior of the cover for distributing cleaning fluid from the source of cleaning fluid onto the surface to be cleaned, wherein the secondary dispenser is positioned to project a spray of cleaning fluid forwardly of the base;

a first valve controlling distribution of cleaning fluid from the primary dispenser;

a second valve controlling distribution of cleaning fluid from the secondary dispenser;

a first switch selectively connected to the first and second valves for effecting the distribution of the cleaning fluid from one of the primary dispenser and the secondary dispenser; and an interlock that prevents the distribution of cleaning fluid from the primary dispenser when the cleaning fluid is distributed from the secondary dispenser.

10. The surface cleaning apparatus from claim 9, wherein the housing further includes a handle pivotally mounted to base, and the handle comprises a first actuator operably connected to the first valve for selectively opening the first valve, and a second actuator operably connected to the second valve for selectively opening the second valve.

11. The surface cleaning apparatus from claim 10, wherein the first and second actuators are positioned on a hand grip of the handle and the first actuator is positioned to be operated by a finger of a user and the second actuator is positioned to be operated by a thumb of the user.

12. The surface cleaning apparatus from claim 9, wherein the source of cleaning fluid comprises a fluid supply tank.

13. The surface cleaning apparatus from claim 9, wherein the source of cleaning fluid comprises multiple fluid supply tanks.

14. The surface cleaning apparatus from claim 13, wherein the primary dispenser distributes the cleaning fluid from one of the multiple fluid supply tanks and the secondary dispenser distributes the cleaning fluid from another of the multiple fluid supply tanks.

15. The surface cleaning apparatus from claim 9 and further comprising a metering valve assembly for selectively controlling the concentration of the cleaning fluid to the primary and secondary dispensers.

16. The surface cleaning apparatus from claim 15, wherein the metering valve is controlled to distribute one concentration of the cleaning fluid to the primary dispenser and a different concentration of the cleaning fluid to the secondary dispenser.

17. The surface cleaning apparatus from claim 9, and further comprising a second switch connected to the first valve for effecting distribution of the cleaning fluid from the primary dispenser.

18. The surface cleaning apparatus from claim 17, wherein the second switch is operable to effect distribution of the cleaning fluid from the primary dispenser when the first switch is connected to the first valve.

19. The surface cleaning apparatus from claim 17, wherein the second switch is not connected to the second valve.

20. The surface cleaning apparatus from claim 9, wherein the interlock comprises an electrical control that prevents the first valve from opening when the second valve is open.

* * * * *